US005268673A

United States Patent [19]

Nelson et al.

[11] Patent Number: 5,268,673

[45] Date of Patent: Dec. 7, 1993

[54] WAVE MOTION DETECTOR FOR SWIMMING POOL

[75] Inventors: Alan H. Nelson; Falle G. Hutton, both of Los Gatos, Calif.

[73] Assignee: Los Gatos Technology, Inc., Los Gatos, Calif.

[21] Appl. No.: 875,245

[22] Filed: Apr. 28, 1992

Related U.S. Application Data

[63] Continuation-in-part of Ser. No. 652,924, Feb. 8, 1991, Pat. No. 5,121,104.

[51] Int. Cl.[5] ..... G08B 13/00

[52] U.S. Cl. ..... 340/566; 340/573; 367/136

[58] Field of Search ..... 340/566, 573; 328/140; 307/272.2, 279, 481; 367/136, 141

[56] References Cited

U.S. PATENT DOCUMENTS 4,932,009 6/1990 Lynch ..... 340/566 X

*Primary Examiner*—Hezron E. Williams
*Assistant Examiner*—Christine K. Oda
*Attorney, Agent, or Firm*—LaValle D. Ptak

[57] ABSTRACT

A swimming pool alarm responsive to wave motion that will produce a signal when two waves exceeding a threshold level of amplitude are sensed within a preset duration of time. A transducer senses air or water pressure changes and produces electrical signals corresponding to the changes. A comparator system, connected to the transducer, receives the transducer signals and, if the signals exceed a preset threshold level, transmits a signal to the discriminator system. The discriminator times the signals received from the comparator and when two signals are received within a specified period of time, a third signal is generated. A warning device such as an alarm is connected to the discriminator and will be activated by the third signal.

5 Claims, 7 Drawing Sheets

WAVE MOTION DETECTOR FOR SWIMMING POOL

RELATED APPLICATION

This application is a continuation-in-part of copending application, Ser. No. 07/652,924, filed on Feb. 8, 1991, U.S. Pat. No. 5,121,104.

BACKGROUND OF THE INVENTION

1. Field of the Invention

This invention relates generally to pool alarms, and more particularly to an improved swimming pool alarm that is sensitive to wave motion, but can discriminate between disturbances caused by entry of a small child or animal into the pool and those caused by wind, rain, etc. (false readings) via a comparator and timer system.

2. BRIEF DESCRIPTION OF THE PRIOR ART

Pool alarms have historically included a transducer placed below the water surface, which detects either high frequency sounds (acoustic) or low frequency disturbances (waves). In both types, an alarm is sounded when a threshold amplitude level is exceeded.

Acoustic pool alarms attempt to overcome the problem of excessive false alarms by sensing high frequency noise components. Although splashing sounds do have a high frequency component, so do loud noises such as traffic and hand clapping, as well as electromagnetic waves generated by nearby power lines. The potential for false alarms can be reduced by the inclusion of a filter, such as is found in U.S. Pat. No. 3,969,712, which filters out loud external noises and electrical disturbances by allowing only large high frequency components to pass through the filter, on to the detector.

Low frequency or wave sensor alarms to date have been found to be too sensitive, and small disturbances such as wind and rain will activate false alarms. If the sensitivity is reduced to a level that will prevent false alarms, the device may not detect the movement of a small child entering the pool. Additionally, these devices are made to float atop the pool surface, tethered by a string to the side of the pool. When someone wishes to use the pool, the device must first be removed from the water, untethered, and then put away to reduce the risk of damage to the device or injury to persons who might run into or trip over the device.

SUMMARY OF THE INVENTION

It is therefore a primary objective of the present invention to provide an apparatus which can detect the entrance of a small, living creature into a swimming pool.

It is also an objective of the present invention to provide an apparatus which will trigger an alarm when it has detected entry into the pool.

Another objective of the present invention is to provide a pool alarm which can detect periodic, low frequency wave disturbances of the type caused by entry of a fairly large object into the pool and compare those disturbances with a fixed signal period pre-set as a threshold.

Briefly, a preferred embodiment of the present invention includes a transducer responsive to pressure variations below the water surface or depth at the water surface, an amplifier connected to the transducer to set the signal level, a low frequency band pass filter connected to the amplifier output to filter out wind, rain and normal poolside traffic, a comparator amplifier to compare the filter output to a fixed threshold amplitude and a periodicity discriminator to determine if an apparent wave is periodic and if the period is consistent with that of a wave caused by a small child or animal entering the water. If the signal output from the filter exceeds the fixed threshold voltage of the comparator twice within a preset duration of time, an audio alarm is sounded. An optional version would include a radio frequency transmitter which would trigger a remote audio alarm.

An important advantage of the present invention is that it will detect, within moments, the unauthorized entrance of an animal or small child into a swimming pool or spa.

Another advantage of the present invention is that an alarm will be triggered in response to detection of an unauthorized entry into the pool.

Yet another advantage of the present invention is that false alarms are greatly reduced due to the use of a comparator which is capable of distinguishing between disturbances of the type caused by a child or animal, and those caused by wind, rain or usual poolside traffic.

A further advantage of the present invention is that, in one embodiment, the switch can be configured to include a predetermined activating/deactivating procedure that must be followed, so that the device is childproof and resistant to accidental disablement.

These and other objects and advantages of the present invention will no doubt become apparent to those skilled in the art after having read the following detailed description of the preferred embodiment which is contained in and illustrated by the various drawing figures.

IN THE DRAWINGS

Figure 3A:
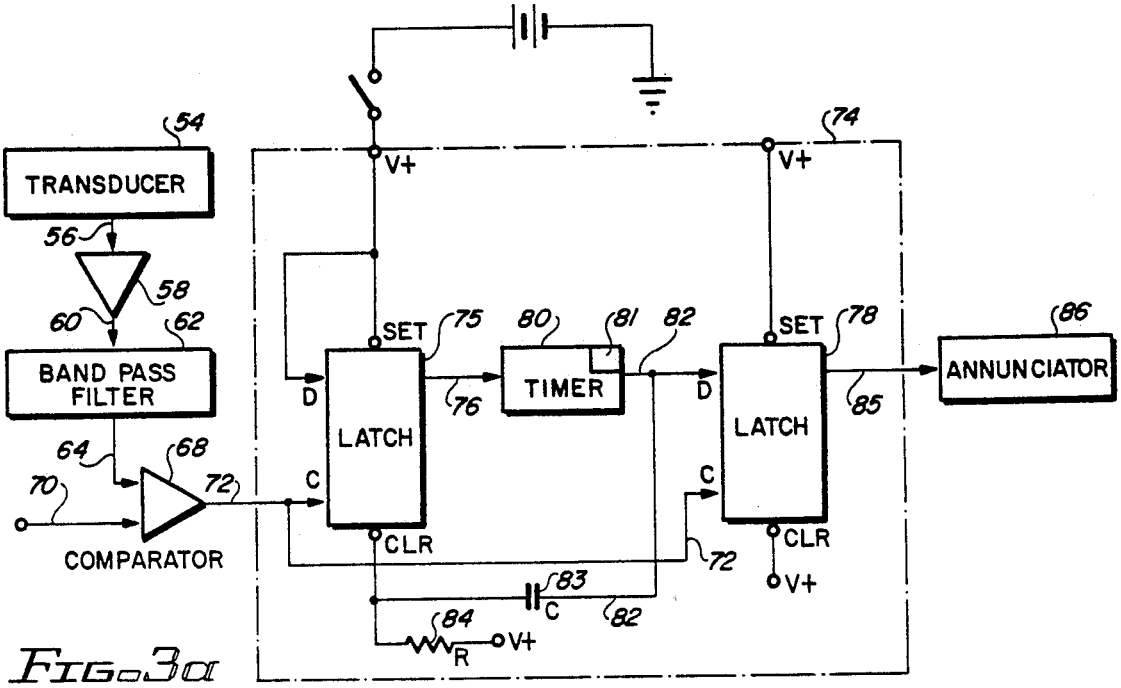

FIG. 3*a* is a block diagram of the circuitry of the present invention.

Figure 3B:
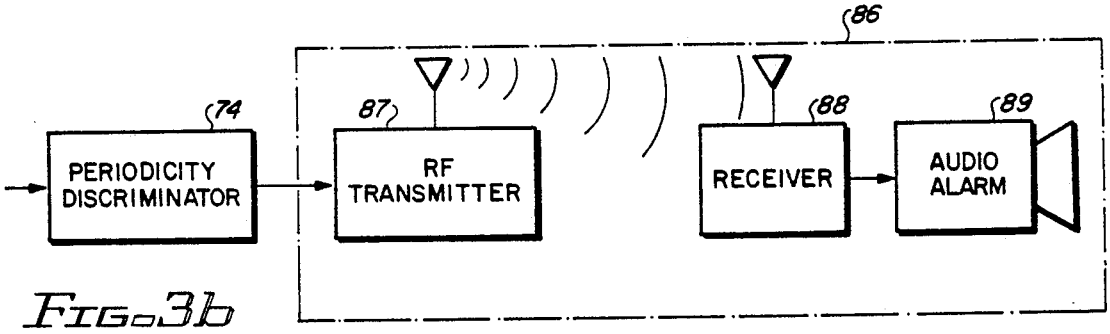

FIG. 3*b* is a block diagram illustrating an alternative embodiment of the annunciator means.

Figure 4:
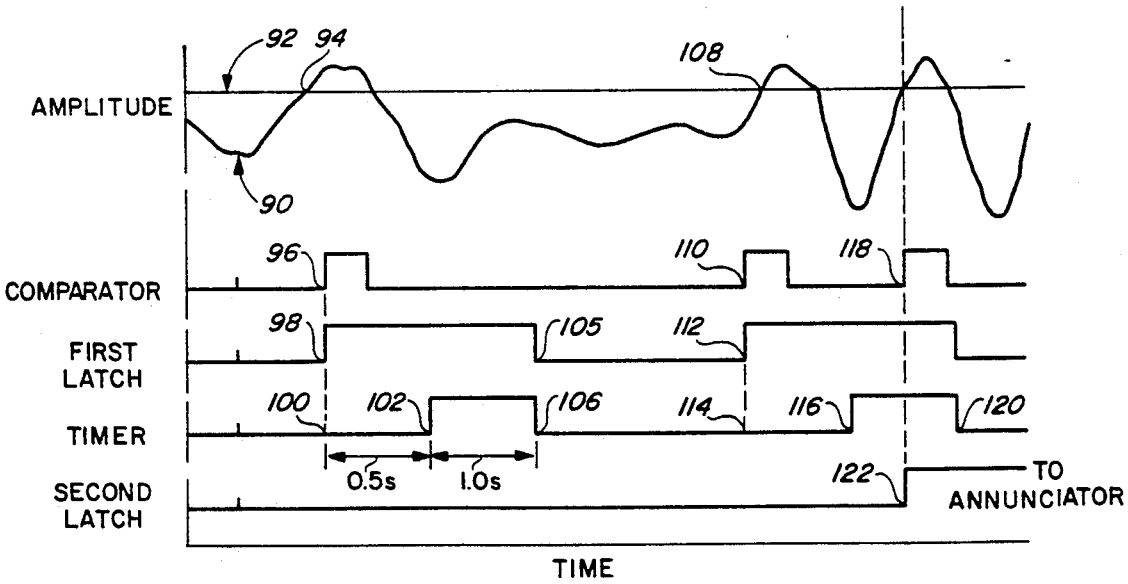

FIG. 4 is a waveform diagram showing two types of disturbances; a low frequency disturbance exceeding the pre-set threshold amplitude only once, thus not activating the alarm, and a periodic disturbance which trips the alarm.

Figure 5:
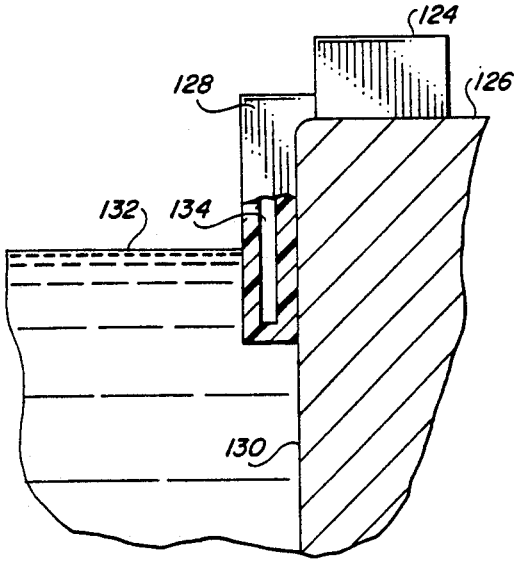

FIG. 5 is a partially broken side elevation view of an alternative embodiment of the present invention, wherein the housing is disposed at the edge of the pool and a pressure communicating conduit protrudes therefrom into the water.

Figure 6:
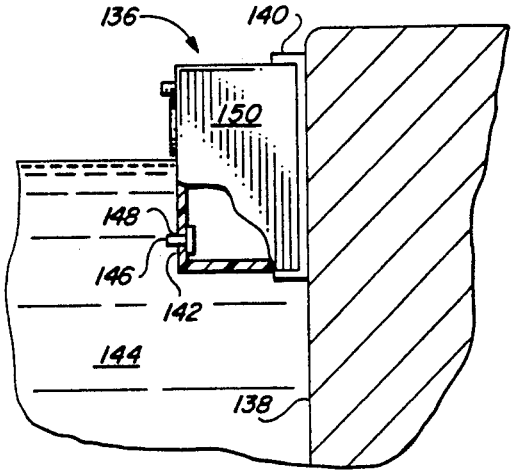

FIG. 6 is a partially broken side elevation view of another alternative embodiment of the present invention which utilizes a pressure transducer whose probe extends from the housing directly into the water.

DETAILED DESCRIPTION OF THE PREFERRED EMBODIMENT

Figure 1:
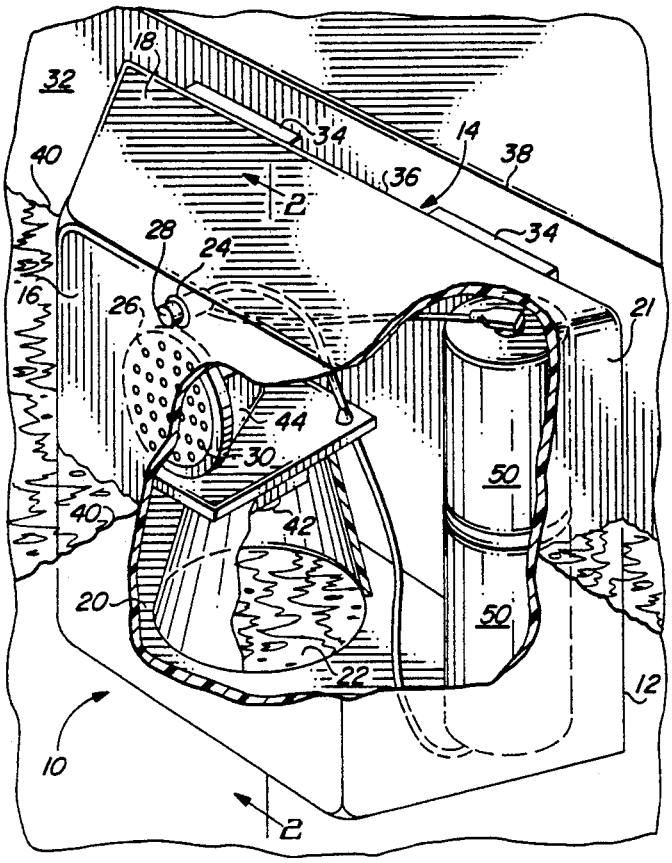
FIG. 1 is a perspective view of the preferred embodiment of the present invention, broken away to show the placement of the components within the housing.

FIG. 1 is a perspective view of the preferred embodiment of the present invention. A device 10 of the present invention is shown with its housing 12 partially broken away to expose the components contained within the housing 12 and show their arrangement. Batteries 50 supply power through a switch 28 to the components residing on the circuit board 44 which determine whether wave motions experienced by the device 10 are of the type which are caused by entry of a small child or animal into the pool. If the comparator and discriminator (shown in a later figure) of the device 10 affirm such wave motions, an alarm is sounded. The speaker 30 provides an audio alarm.

As depicted, a device 10 includes a rhomboid-shaped housing 12 having a large rear panel 14 and a front panel 16 that is smaller in width than said rear panel 14. The top panel 18 is removable from the rest of the housing 12 to allow for servicing of the device 10. The bottom panel 20 is deformed inwardly such that a conically-shaped cavity 22 exists in the underside of the device 10. The front panel 16 includes two cut outs 24 and 26, through which the switch 28 and speaker 30 are exposed.

The device 10 attaches to the side wall 32 of a swimming pool via foam tape 34, which is disposed along the outside of the rear panel 14 proximate the joinder 36 of the top panel 18 and rear panel 14. The placement of the device 10 proximate the top edge 38 of the pool wall 32 ensures that the speaker 30 and switch 28 will stay dry while the greater portion of the conical cavity 22 is maintained below the surface of the water 40. Other types of fasteners, such as waterproof adhesive or Velcro®, may be used in the alternative. It is preferable that the fastening means be nonpermanent so that the device 10 can be removed from the water prior to servicing, thereby reducing the risk of contaminating the components with the chlorinated pool water. An alternative to adhesive fastening means is a snap together bracket and housing configuration. A bracket, permanently fastened to the side of the pool, received and engages the housing of the device whereby the bracket and rear panel of the housing securely snap together.

The waterproof housing 12 encapsulates the components. The housing 12 in this figure is broken away along the left side panel 21 and the part of the front panel 16 to expose the components contained therewithin. Generally, a pressure transducer 42 is connected to a circuit board 44 on which the comparator 46 and discriminator 48 as well as the operating circuitry for the alarm speaker 30 reside (components and circuitry not shown). The circuit board 44 is disposed in a horizontal position between two pairs of batteries 50 (only one pair is shown), which provide power to the device 10 through an on/off switch 28.

More specifically, the device operates on four 1.5 D-cell batteries 50, thus eliminating the risk of injurious electric shock to anyone in or around the pool, because no external plugs or wiring are used. Only one pair of the batteries 50 is shown in this figure. Two 3 V batteries or one 6 V battery could be used in the alternative. The batteries 50 provide the power via an on/off switch 28. The switch 28 is exposed through the topmost cut out 24 in the front panel 16 so that it is at the furthest extreme from the surface of the water 40 and conveniently accessible by the operator. An alternative to a simple on/off switch 28 is one that is tamper resistant, or child-proof,whereby it would require that the operator follow a predetermined activating/deactivating procedure such as pressing a pre-programmed sequence of buttons.

A speaker 30 is located just below the switch 28 and exposed by the cut out 26. Like the switch 28, the speaker 30 is located above the water's surface 40. A circuit board 44 is disposed in a horizontal position between each pair of batteries 50 just below the speaker 30. A pressure transducer 42 detects changes in water pressure and sends corresponding electrical signal to the circuit board 44. The circuit board 44 contains the comparator 46 and discriminator 48 circuitry. the comparator 46 likens the incoming signal's amplitude with a pre-set threshold amplitude and, when the two amplitudes are equal, will relay an output signal to the discriminator 48. The discriminator 48 receives the output signal from the comparator 46 and, when two comparator signals are received within a predetermined time, will trigger an alarm which sounds the speaker 30. The comparator 46 and discriminator 48 systems will be discussed in detail to follow.

Figure 2:
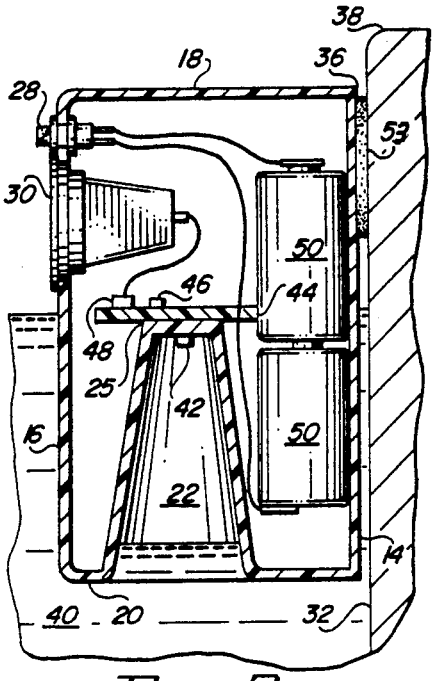
FIG. 2 is a cross section of the device of the present invention, taken along line 2—2 of FIG. 1, illustrating the conical cavity in the underside of the device.

The bottom panel 20 of the device curves upwardly, forming a cone-shaped cavity 22 in the underside of the device 10. This configuration is better illustrated in FIG. 2. At the apex of the cavity is a cut out 25 which exposes the pressure transducer 42. When the device 10 is placed in position in a swimming pool. the surface of the water 40 will rest at the midpoint of the height of the device. This, the upper half of the device, including the speaker 30 and switch 28, will remain above the water line 40 and the lower half of the device will be submerged, whereby air will be trapped within the cavity 22 when the device 10 is lowered into place in a pool. The pressure of the air within the conical space 22 will change commensurate with changes in water pressure brought about the movement of the water in the pool. The transducer 42 senses these pressure changes and relays corresponding electrical signals to the attached circuit board 44 which, as previously stated, determines whether the wave motion sensed by the transducer 42 is of the type caused by the entry of a child or animal into the pool.

When the system detects wave motion of the type that indicates that a fairly large object has entered the pool, an alarm speaker 30 is activated. An alarm will sound, alerting persons in the immediate vicinity that there has been an unauthorized entry into the pool.

Also shown in this figure is the use of Velcro® 53 as a means of fastening the device to the pool wall 32.

FIG. 3*a* is a simple schematic which illustrates the principal operative components and circuitry of the present invention. A transducer 54 relays electrical signals to a comparator 68 which determines if the amplitude of the wave sensed by the transducer 54 surpasses a pre-set threshold 70. If so, the comparator 68 transmits a signal to the discriminator 74 which will trigger an alarm or annunciator 86 if the low frequency of the wave detected is of the type generated by the entry of a child or animal into the pool.

The pressure transducer 54 responds to pressure variations of the water within the pool. The output 56 of the transducer 54 is received by a first amplifier 58 which sets the level of the signal providing a gain of 83 dB. The signal 60 the first amplifier 58 is then passed through a low frequency band pass filter 62 that screens out extraneous noise having a frequency of greater than 1.5 Hz, which would normally cause a false reading. The output of the filter 62 is received as one input of a second amplifier 68 which is configured as a comparator. The second amplifier 68 compares the amplitude of the filtered signal with a pre-set threshold amplitude 70 that is the second input into the comparator. Where the filtered signal 64 exceeds the pre-set threshold amplitude 70, an output signal 72 is sent to a periodicity discriminator 74 which determines whether the disturbance sensed by the transducer 54 is of the type which would be caused by a child or similarly sized object entering the pool.

The periodicity discriminator system 74, shown by the dashed lines, is comprised of a first and a second latch 75 and 78, and a timer 80. When a signal 72, indicating that a disturbance exceeding the threshold level 70 has been sensed, is output by the comparator 68, it is received by the first latch 75 and the second latch 78. The first latch 75 will set causing a signal 76 to be transmitted to the timer 80. The second latch 78 also receives the signal 72 but will not set without a concomitant signal from the timer 80. Upon receipt of signal 76 from the first latch 75, the timer 80 starts to run. After the timer 80 has run for 0.5 seconds to 0.66 seconds (the first portion of the timer run), an internal latch 81 is set and provides an output signal 82 for the duration or second portion of the timer's run (an additional 0.66 seconds to 1.0 seconds for a total of approximately 1.33 seconds to 1.5 seconds for the entire run). When the timer runs out, the first latch 75 is reset through the capacitor 83 as a result of the negative transition in the output signal 82 of the timer 80. The resistor 84 maintains the signal to the first latch 75 until a negative transition in the output 82 of the timer 80 is experienced. However, if a second signal is transmitted from the comparator 68 during the period that the timer's internal latch is set (the second portion of the timer's run) the second latch 78 will set because it is already receiving a signal 82 from the timer's internal latch 81 when it receives another signal 72 from the comparator 68. Upon setting, the second latch transmits a signal 85 which is relayed to an annunciator 86. The annunciator can be an alarm or other type of warning bell, buzzer or horn.

The warning system is flexible. A bell or other type of audio alarm can be contained within the housing of the pool alarm. Optionally, as shown in FIG. 3*b*, the annunciator 86, coupled to the periodicity discriminator system 74, can be located remotely, and comprise a radio frequency transmitter 87 contained within the device and a remote receiver 88 which includes an audio alarm 89. Electromagnetic radiation or infrared radiation also can be utilized for the transmitter 87 and receiver 88 in place of radio frequency transmission and reception, if desired. In addition to audio alarms, visual alarms such as blinking lights can also be utilized.

Initiation of operation of the pool alarm system can be accomplished through means as simple as an on/off switch attached to the power circuit battery, or a much more advanced process such as a preprogrammed sequence of pushbuttons which would provide security from accidental or unauthorized disabling of the alarm system. Arming and shut off of the alarm can be performed poolside, as an internal (waterproof) part of the detector, or remotely such as from inside a house or cabana.

Once the power is turned on, the system awaits wave motions that cause pressure changes in the pool water, and proportional changes in the pressure of the air trapped within the housing cavity. The pressure changes are sensed by a transducer and cause the transducer to output corresponding electrical signals which are received and amplified by a first amplifier. The amplified signals are passed through a low frequency filter which reduces false readings (and thus false alarms) by only allowing signals commensurate with a large object entering the pool to pass through.

FIG. 4 is a waveform diagram which illustrates how the comparator and discriminator process signals from the transducer. For the following discussion, the reader must consider the diagram as a whole, and as a progression from left to right. Filtered electrical signals 90 from the transducer are transmitted to a comparator which compares the filtered signal 90 with a fixed threshold amplitude 92. When the filtered signal 90 exceeds the threshold amplitude 92 as indicated by point 94, the comparator sends a signal 96 from which a first latch is set 98. The timer 100 runs for 1.33 seconds to 1.5 seconds. After the timer has run for 0.5 to 0.66 seconds, an internal timer latch is set 102 and remains set for the duration of the timer period (the second portion)—in other words, the internal timer latch remains set for 0.66 seconds to 1.0 seconds. If, within this second portion of the timer period, a second filtered signal exceeding the threshold amplitude is not experienced, the first latch is reset (see point 105) by the negative transition 106 of the timer as it runs out after its full run or period of activation. No alarm is triggered.

On the other hand, where the filtered signal has risen above the threshold level a first time, thereby setting the first latch and activating the timer, fallen below the threshold, and then exceeded the threshold a second time within the period of time that the timer's internal latch is set, a second latch is set, thus providing an annunciator signal.

Considering the signal disturbances shown in the right portion of FIG. 4 in more detail, when the comparator detects an incoming amplified and filtered signal 90 that is greater in amplitude than a pre-set threshold 92, as shown by point 108, the comparator transmits a signal 110 which sets the first latch, as indicated by point 112. A timer 114 is activated concurrently with the setting of the first latch 112, and runs for a total run duration of 1.33 seconds to 1.5 seconds. After the timer has run for 0.5 seconds to 0.66 seconds, an internal timer latch is set 116 and remains set until the timer runs out. If a second signal 118 is transmitted from the comparator after the internal timer latch has been set 116, but before the timer runs out 120, the second comparator signal sets a second latch 122. The setting of the second latch sends a signal to an annunciator which causes the alarm to sound. The operator can disable the alarm by turning the system off, thereby resetting the discriminator system.

Thus , the alarm is only enabled when the filtered signal exceeds the threshold amplitude at least twice within a period of approximately 1.33 seconds to 1.5 seconds, and the time between such greater than 0.5 to 0.66 seconds. The time between waves in a typical backyard pool is approximately 1.0 seconds, thus the double signal requirement of the present invention reduces the occurrence of false alarms.

As an alternative, a second timer can be connected to the alarm to disable it after a predetermined amount of time. For example, the second timer could shut off the tripped alarm after three minutes and cause the entire system to reset itself into a ready mode.

FIG. 5 illustrates an alternative embodiment of the present invention. The housing, components and circuitry of device 124 in this illustration corresponds to the device 10 of FIG. 1. The device 124 can be housed in any waterproof form and set atop the edge of the pool 126. This embodiment is preferred for use with Doughboy® pools which are a preformed plastic tub having thin walls. For this configuration, a cylindrical conduit 128 attached to the device 124 extends down the side of the pool 130 and into the water 132. The conduit 128 traps air 134 within its length, thereby creating trapped pressurized air. Pressure changes of the trapped air, caused by changes in water pressure, i.e. wave motion, are determined by the pressure transducer.

FIG. 6 shows yet another alternative embodiment. A device 136, is similar to that in FIG. 1, is attached to the side of a pool 138, and securely held by a snap bracket 140. Instead of using trapped air as the source of pressure from which the transducer 142 indirectly measures changes in the water pressure or wave motion, in this embodiment the transducer itself is disposed directly in the pool water 144. The probe 146 of the transducer extends from an opening 148 in the device's housing 150, into the water 144 below the surface and measures water pressure changes directly. The probe 146 may be covered with an inert material to avoid the corrosion and decay that would be caused by chlorine and other chemicals added to swimming pool water.

The housings shown in these drawings are for illustrative purposes only. Other shapes of housings, such as semi-circular, may also be used, as long as the shape allows for a pool sweep to easily pass around the device. A rectangular shape, for example, tends to trap the pool sweep and prohibit it from continuing along its path around the perimeter of the pool.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. A wave motion detector for a swimming pool comprising:

transducer means responsive to pressure changes in swimming pool water caused by the entry of a body into the pool to generate corresponding electrical signals;

comparator means responsive to said electrical signals and operative to provide a detection signal each time said electrical signal exceeds a predetermined threshold level; and discriminator means responsive to said detection signals and operative to generate an alarm signal each time a first detection signal is followed by a second detection signal occurring during a predetermined second portion of a predetermined time period following said first detection signal, said predetermined time period being approximately 1.33 seconds to 1.5 seconds in duration, and said second portion is equal to or less than one half of said time period.

2. A detector as recited in claim 1 further comprising annunciator means connected to said discriminator means for generating an audible sound upon receipt of said alarm signal.

3. A detector as recited in claim 2 wherein said annunciator means includes a transmitter which transmits alarm signals via one of electro-magnetic radiation and infra-red radiation to a receiver that communicates said alarm signals.

4. A detector as recited in claim 3 wherein said receiver communicates said alarm signals by sounding an audio alarm.

5. A wave motion detector for a swimming pool comprising:

transducer means responsive to pressure changes in swimming pool water caused by the entry of a body into the pool to generate corresponding electrical signals;

comparator means responsive to said electrical signals and operative to provide a detection signal each time said electrical signal exceeds a predetermined threshold level; and discriminator means responsive to said detection signals and operative to generate an alarm signal each time a first detection signal is followed by a second detection signal occurring during a predetermined second portion of a predetermined time period following said first detection signal, said predetermined time period being approximately 1.33 seconds to 1.5 seconds in duration, said discriminator means comprising:

(a) a first latch operated by said first detection signal, indicating that said threshold has been exceeded a first time;

(b) timer means for determining the duration of said predetermined time period; and (c) a second latch for activating said alarm signal when said second detection signal is received from said comparator means within the duration of said second predetermined portion of said predetermined time period.

* * * * *